US010336516B2

(12) United States Patent
Heim et al.

(10) Patent No.: US 10,336,516 B2
(45) Date of Patent: Jul. 2, 2019

(54) CHILDPROOF SAFETY CAP AND ASSOCIATED CONTAINER FOR LIQUID OR PASTY SUBSTANCES

(71) Applicant: AERO PUMP GMBH, Hochheim am Main (DE)

(72) Inventors: Ralf Heim, Wiesbaden (DE); Andreas Mersmann, Frankfurt (DE)

(73) Assignee: AERO PUMP GMBH (DE)

( * ) Notice: Subject to any disclaimer, the term of this patent is extended or adjusted under 35 U.S.C. 154(b) by 0 days.

(21) Appl. No.: 15/537,841

(22) PCT Filed: Dec. 17, 2015

(86) PCT No.: PCT/EP2015/080223
§ 371 (c)(1),
(2) Date: Jun. 19, 2017

(87) PCT Pub. No.: WO2016/097145
PCT Pub. Date: Jun. 23, 2016

(65) Prior Publication Data

US 2018/0016067 A1 Jan. 18, 2018

(30) Foreign Application Priority Data

Dec. 19, 2014 (CH) ..... 1993/14

(51) Int. Cl.
*B65D 50/04* (2006.01)
*B65D 41/04* (2006.01)
(Continued)

(52) U.S. Cl.
CPC ..... *B65D 50/043* (2013.01); *A61J 1/1418* (2015.05); *B65D 25/40* (2013.01);
(Continued)

(58) Field of Classification Search
None
See application file for complete search history.

(56) References Cited

U.S. PATENT DOCUMENTS 3,339,770 A * 9/1967 Weigand ..... B65D 41/06 215/214
3,659,735 A * 5/1972 Landen ..... B65D 41/06 215/222

(Continued)

FOREIGN PATENT DOCUMENTS

EP 0042603 A1 12/1981
EP 0343778 A1 11/1989
JP S5355352 U 5/1978

OTHER PUBLICATIONS

International Search Report; PCT Application No. PCT/EP2015/080223; dated Mar. 22, 2016.

(Continued)

*Primary Examiner* — David P Angwin
*Assistant Examiner* — Bob Zadeh
(74) *Attorney, Agent, or Firm* — Polsinelli PC

(57) ABSTRACT

Childproof safety cap has two opposite bead-like threads on its inner wall. Each thread has a widened end region, a stop surface thus being formed. The associated bottle has two opposite groove-like threads on a connecting piece of the bottle, each of which threads has a widened region in the end region, an undercut thus being formed in the groove by the widened region. When the safety cap is screwed on, the stop surfaces on the two bead-like threads hook in behind the undercuts on the groove-like threads. The stop surfaces can be released from each other only if the safety cap is pressed down toward the bottle onto the connecting-piece neck. Connecting-piece neck forms a slipping surface that coni- (Continued)

Figure 1:
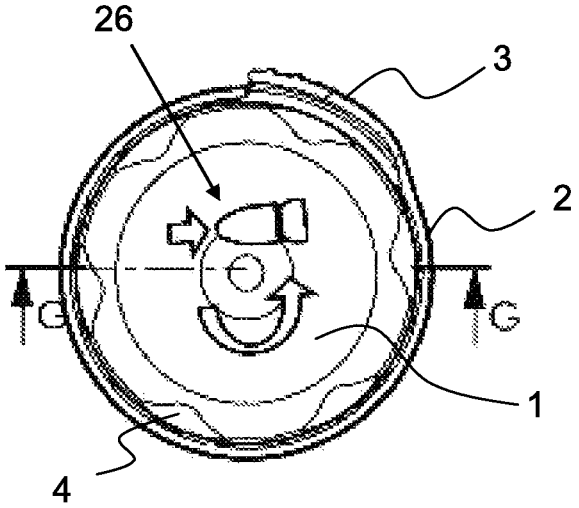

cally expands downwards. The safety cap can then be unscrewed while simultaneously being rotated.

3 Claims, 5 Drawing Sheets

(51) Int. Cl.
*A61J 1/14* (2006.01)
*B65D 25/40* (2006.01)

(52) U.S. Cl.
CPC .. *B65D 41/0485* (2013.01); *B65D 2101/0038* (2013.01); *B65D 2215/02* (2013.01)

(56) References Cited

U.S. PATENT DOCUMENTS 3,828,957 A * 8/1974 Marchant ..... B65D 50/043 215/222
3,927,783 A * 12/1975 Bogert ..... B65D 41/06 215/222
5,156,303 A * 10/1992 Yamamoto ..... B65D 35/38 222/107
5,593,055 A * 1/1997 Repp ..... B65D 1/023 215/256
5,680,954 A * 10/1997 Arnold ..... B65D 39/0023 215/214
6,155,462 A * 12/2000 Brecheisen ..... B05B 11/001 215/276
7,841,491 B2 * 11/2010 Contiero ..... B05B 11/3045 222/153.01
2007/0039914 A1 * 2/2007 Buono ..... B65D 50/046 215/222
2008/0000932 A1 * 1/2008 Cleary ..... B65D 1/0223 222/215
2018/0016067 A1 * 1/2018 Heim ..... B65D 41/0485

OTHER PUBLICATIONS

English Translation of International Search Report; PCT Application No. PCT/EP2015/080223; dated Mar. 22, 2016.
Written Opinion of PCT Application No. PCT/EP2015/080223; dated Mar. 22, 2016.
English Translation of Written Opinion; PCT Application No. PCT/EP2015/080223; dated Jun. 7, 2017.
English Language Abstract of JPS5355352 Obtained From www.espacenet.com on Jun. 20, 2017.

* cited by examiner

CHILDPROOF SAFETY CAP AND ASSOCIATED CONTAINER FOR LIQUID OR PASTY SUBSTANCES

CROSS-REFERENCE TO RELATED APPLICATIONS

This application is a national stage entry of PCT/EP2015/080223 filed Dec. 17, 2015, which claims convention priority from Swiss provisional patent application 01993/14 filed on Dec. 19, 2014, the contents each of which are hereby incorporated by reference in their entirety.

This invention relates to a protective cap having an associated container or bottle for liquid or pasty media, thus for closures, dosage systems or application systems such as sprays or droppers of bottles with arbitrary contents, among other things also pharmaceutical preparations which should be stored in a child-resistant way. This means such a protective cap should ensure that the container or the bottle cannot opened by an infant's hand at all. It is to be accomplished by this protective cap not being normally removable by an infant's hand, at least not straightaway, from a closure or dosage system of the container or the bottle so that the content is inaccessible to the infant.

Many pharmaceutical substances and preparations, which are dosed and output by application systems like nasal sprays or eye droppers, contain substances which are potentially dangerous to children. Of course every closure, which is ultimately openable, will at some point be opened by resourceful older children, primarily if they have the necessary physical strength for this. If, however, a closure requires a certain expenditure of physical force for opening, it can be designed in such a way that it is definitely not openable by infants, and can be opened by larger children only very unlikely or at least with difficulty.

Such application systems, for example drip bottles for outputting countable drops, are comparatively small bottles of few centimeters in height and a diameter of likewise only about 2 cm, to give an order of magnitude. They are employed for all kinds of liquid or viscous chemicals or drugs, which are required in small amounts and are therefore applied by dripping. Eye-drop liquid is typically dispensed in such a dripping bottle. The liquid can be dripped into the eye a drop at a time. For nasal sprays, the application system contains a pump for generating a spray jet which for applying is directed into the nose. In a similar manner and with still further closure systems, other substances can also be dispensed in such bottles, for instance toxic chemicals, glues, colors, lacquers, solvents and the like.

In the case of drip bottles for eye drops, these have a conically tapered nozzle spout in the form of a dosing tube. This nozzle spout is sealingly inserted into the bottle mouth, which is slightly tapered compared to the bottle. The bottle mouth itself is externally equipped with a screw thread. The associated bottle closure forms a thimble-type cover with an inside thread, which can be screwed onto this outside thread at the bottle mouth. This closure, however, does not offer guarantee that the bottle cannot be opened straight away by a child or infant if it unintentionally gets into their hands. If the child then possibly sucks or drinks from the bottle, serious health problems can result. To preclude children's access to these substances or to at least impede it substantially, a system should be found which makes it distinctly more difficult for children to attain the corresponding substance or to utilize the application system.

The object of the present invention is thus to provide a child-resistant protective cap for an associated container or bottle for liquid or pasty media, so that application system belonging to the container or bottle is not accessible to infants and is accessible by larger children only highly unlikely and is thus not activatable or a lock is not openable. In a variant, the protective cap should moreover have an initial-opening guarantee device and it should be executed in such a way that it counteracts an unintentional evaporation of the container's content. It should be designable in different variants so that, depending on the embodiment, more or less physical force is required for removing said protective cap.

This object is achieved in detail by a child-resistant protective cap having an associated container for liquid or pasty media, in particular also for pharmaceutical application systems which are characterized in that the protective cap and the container are each equipped with at least one thread, which engage each other by the one thread (6) being bead-like outwardly protrudingly shaped and the other thread (15) being recessed in a groove-like manner, and wherein at the lower end of the thread (6) on the protective cap (1) or bottle (9) there is configured on the bead-like thread (6) a widened region (7) which is screwable in the groove-like thread (15) along the same and at its back end forms a stop face (8), and wherein said widened region (7), in the end position of screwing on the protective cap (1), engages a wider region (17) in the groove-shaped thread (15) on the bottle (5) or protective cap (1), which wider region (17) forms an undercut (18), so that the stop face (8) on the bead-like thread catches behind the undercut (18), and the stop face (8) is squeezable under the undercut (18) only by pressing the protective cap (1) toward the bottle (9) with slight elastic deformation of its walling in the mouth region, and is hereinafter unscrewable upon simultaneous rotation.

The basic idea thus is to completely cover and enclose the closure of the container or its application system with the help of a protective cap. When in mounted position on the container, the protective cap normally prevents access to the closure or the application system and therefore also to the content of the container. To be able to use the closure or the application system, the protective cap must first be taken off. The taking-off of the protective cap is blocked by a mechanism, which must be unblocked for the purpose of using the lock or application system before the protective cap can be removed.

In the figures, an exemplary embodiment of this child-resistant protective cap is shown in several representations and its function is explained with the help of these drawings.

Figure 2:
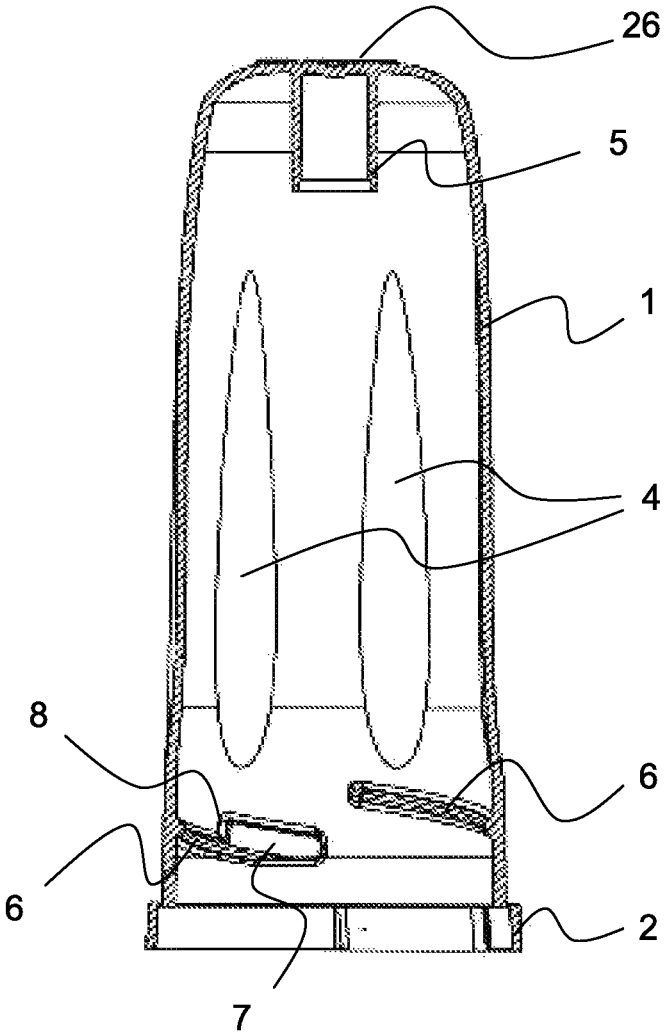
Figure 3:
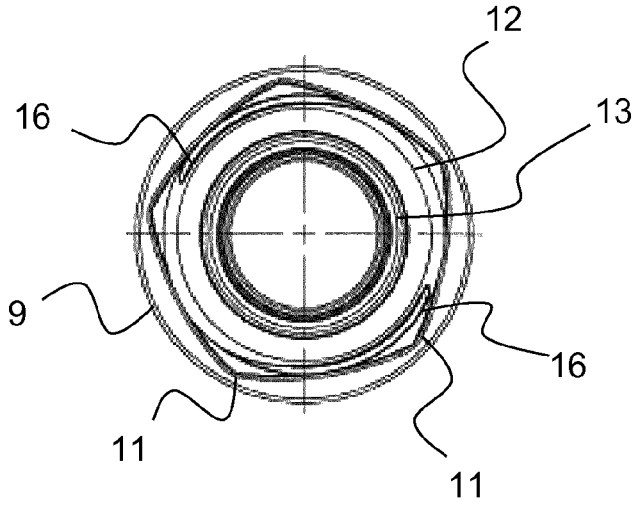
Figure 4:
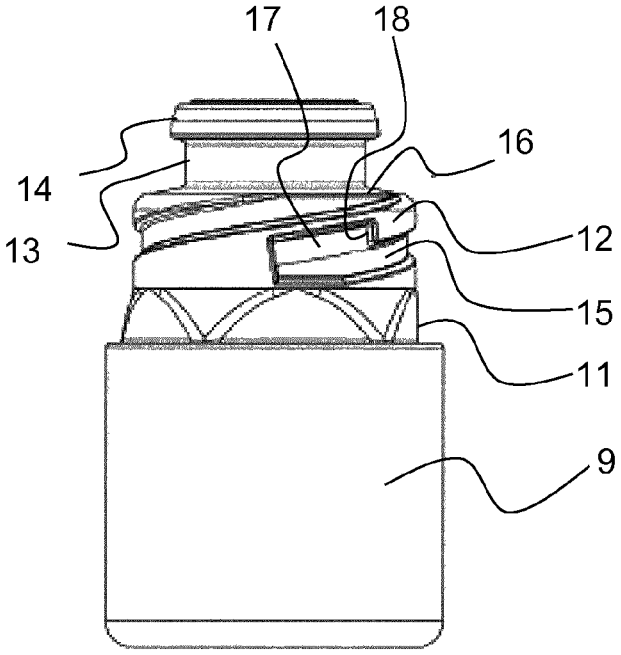
Figure 5:
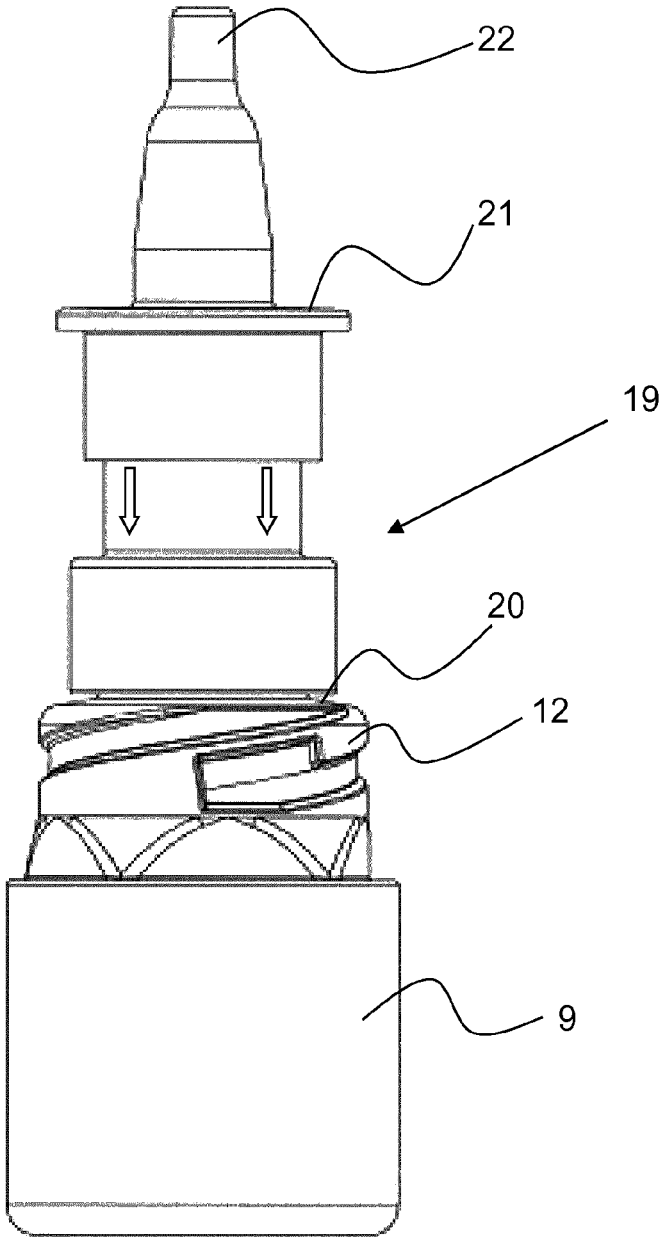
Figure 6:
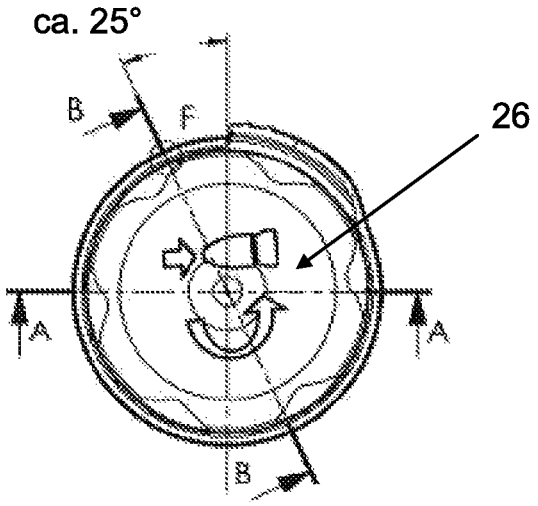
Figure 7:
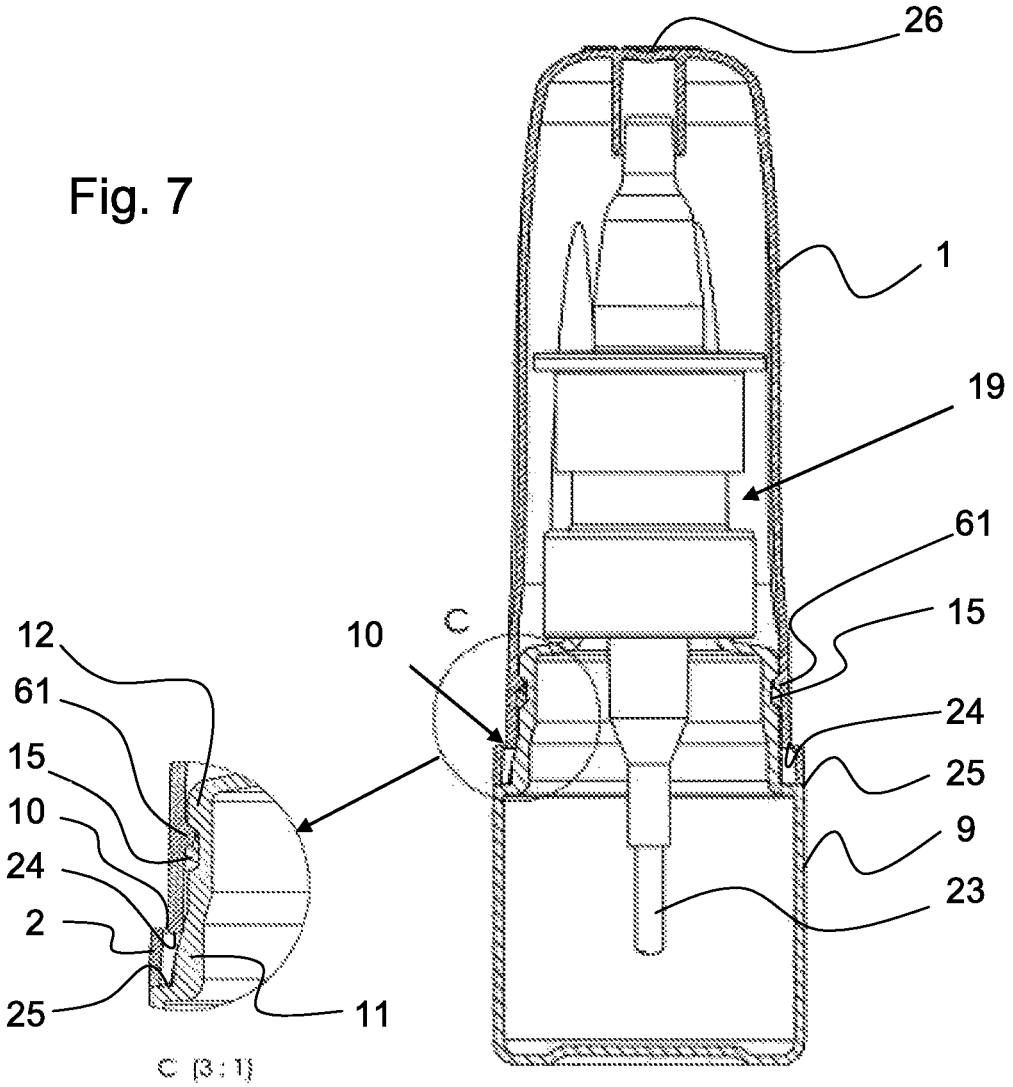
Figure 8:
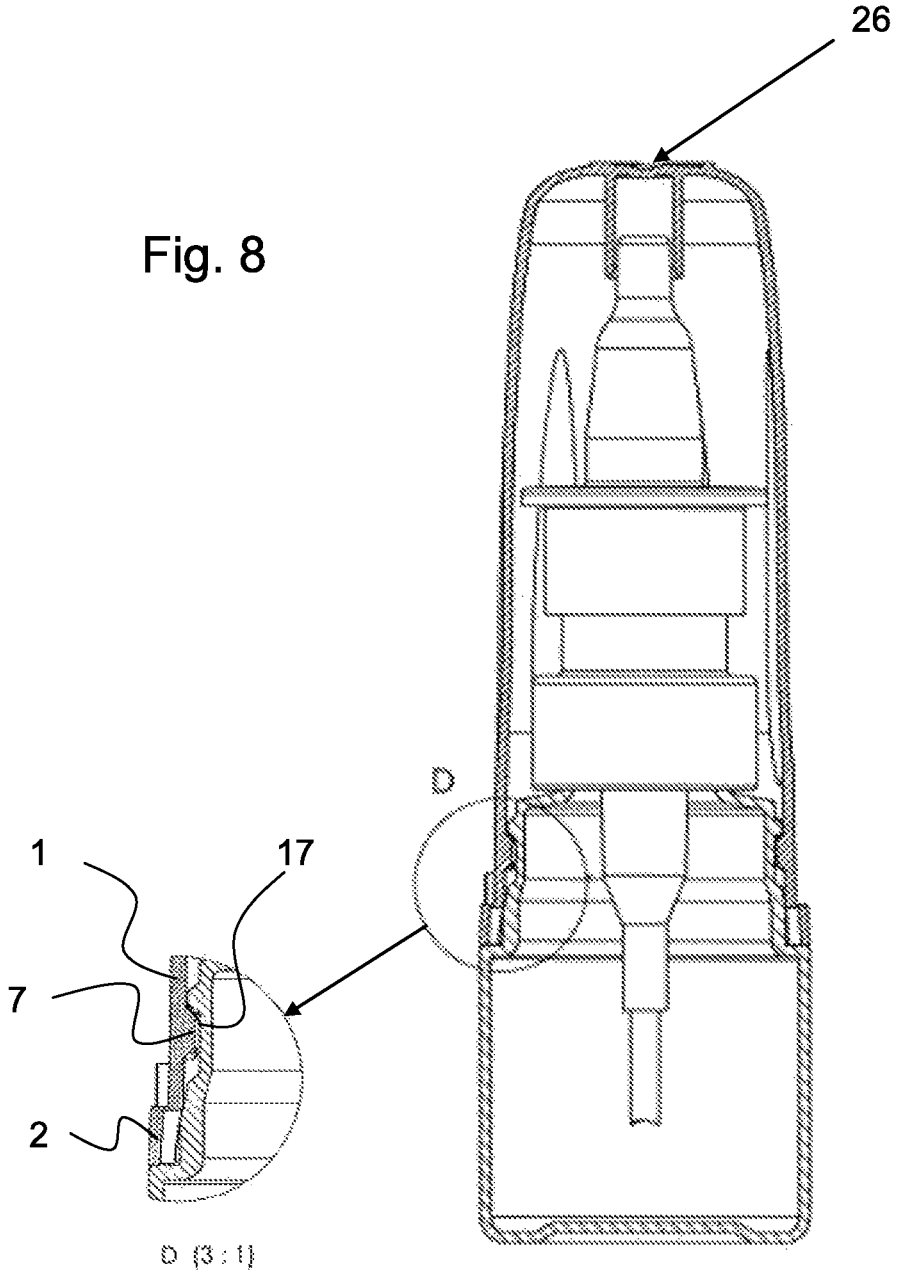

There are shown:

FIG. 1: The protective cap as seen from above;

FIG. 2: The protective cap represented in a longitudinal section along the rotational axis;

FIG. 3 A plan view of a bottle as the container with its spout, without the application system to be mounted;

FIG. 4: The bottle represented as an outline as a container without application system;

FIG. 5: The bottle represented as an outline as a container with application system mounted thereupon;

FIG. 6: The protective cap as seen from above, wherein the deblocking movement is indicated by arrows, namely first press, then rotate;

FIG. 7: The bottle represented as an outline as a container with application system mounted thereupon and the protective cap mounted thereupon, wherein the bottle and protective cap are represented in a longitudinal section along the line A-A of FIG. 6;

FIG. 8: The bottle represented as an outline as a container with application system mounted thereupon and the protective cap mounted thereupon, wherein the bottle and protective cap are represented in a longitudinal section along the line B-B of FIG. 6.

At first in FIG. 1 one sees this child-resistant protective cap 1 as seen from above onto the end face. The circumferential band is a tamper-evident band 2 with a tab 3 for tearing away before the initial removing of the protective cap 1. On its side walls, the protective cap 1 has indentations 4 which extend along the protective cap 1 and extend over about half of its total height, wherein they facilitate the rotating or screwing off as soon as the child-resistant blocking has been eliminated. At the top of the end face of the protective cap 1, the handling is indicated by arrows, namely first pressing the protective cap 1 against the container and subsequently following the bent arrow in counterclockwise direction for the subsequent unscrewing of the protective cap 1 under persistent initial pressing of the protective cap 1.

In FIG. 2, the protective cap 1 is represented in a longitudinal section along the rotational axis, that is, along the diametrical line G-G in FIG. 1. At the top of the inner side of the cap cover 26 it forms a sleeve 5 which protrudes downwardly concentrically to the end face and is intended for being put over the mouth 22 opening spout of the application system. On the one hand this closes the mouth 22 when the protective cap 1 is mounted thereupon and acts as an evaporation protection, whereby a too strong evaporation of the liquid located in the application system is prevented; on the other hand, this sleeve 5 gives stability to the protective cap 1 if it is unscrewed by means of a rotation because then the mouth 22 acts as an axis around which the protective cap 1 rotates with its sleeve 5. On the inner side of the rear side wall of the protective cap 1 visible here, one recognizes the indentations 4 on its outer side, which on the inner side of the protective cap 1, visible here, form corresponding bulges. In the lower region of the protective cap 1, one recognizes two bead-like inwardly curved threads 6, in the form of a crease protruding from the inner wall of the protective cap 1. In the example shown, there are two such threads 6 facing each other at 180°, and each extend a little more than 180° around the extent of the protective cap 1. What is special in these threads 6 is that they form an end portion 7 thickened at one side, here upwardly, the rear end correspondingly each a stop face 8 is formed. In order for the system to function, at least a single such thread 6 is required. Advantageously, however, two threads 6 are provided, as in the shown example, or for greater diameters of the protective cap 1, even three or more threads. At the lower edge of the protective cap 1, a tamper-evident band 2 is molded over one thin section or several predetermined breaking points.

The FIG. 3 shows a plan view of the container, here onto the bottle with its spout, without the application system to be mounted thereupon. The bottle body 9 is shaped cylindrically and on it sits first a neck, pentagonal in the plan view 11, which runs upwardly into a cylindrical spout 12 having a somewhat smaller diameter and this is finally run into in an again tapered mouth opening spout 13. Outside on the spout 12, one recognizes two upper ends 16 of groove-like threads, which end at this point as becomes clear with the help of the next FIG. 4. This FIG. 4 represented below FIG. 3, shows the bottle 9, represented as an outline, with its spout 12 without the application system mounted thereupon. One recognizes the cylindrical bottle body 9, the neck 11, the spout 12 mounted thereupon and on the same the mouth opening spout 13 which forms an outwardly projecting edge region 14. The neck 11 of the bottle spout 12 flares downwardly and is pentagonal in shape, when viewed from above as in FIG. 3, so that the corner faces running conically downward outward form slide-off surfaces for the lower edges of the screwed-on protective cap. Upon pressing down, the protective cap slips down these conical corner faces and thereby adapts itself elastically to the pentagonal form of the container. As a specialty, the spout 12 equipped with two mutually opposing groove-like threads 15 is equipped with a little bit more than one circumference of 180°. With their ends, these threads 15 form a region 17 in which the groove is broadened upward, so that a back section 18 is formed there from which the groove 15 is broadened. If the inner side of the protective cap has only a single thread with bead, this also holds for the spout 12 of the bottle 9, which then has a single matching groove-like thread. Moreover, it should be mentioned that conversely also the protective cap can be equipped with one or several groove-like threads, and then the one or more bead-like threads are correspondingly shaped on the bottle or on its spout 12. Upon screwing on the protective cap 1 shown in FIG. 1, its two bead-like threads 6 with their thickened end regions 7 slide downward along the groove-like threads 15. In the final phase, the screwing on of the protective cap 1 is effected under slight elastic deformation of the walling of its lower mouth region. Upon releasing it, it is hence thrust axially upward and the thickened regions 7 of the bead-like threads 6 catch the broadened regions 17 in the two groove-like threads 15. Their stop faces 8 catches behind the undercuts 18 in the broadened grooves 15. The protective cap 1 is thus blocked in a child-resistant way and cannot readily be unscrewed.

The FIG. 5 shows the bottle 9 having the application system 19 mounted upon its spout, represented as an outline. The mouth opening spout 13 is non visible here because the application system 19 is put over it. The application system 19 rests on the shoulder 20 formed above by the spout 12. To apply substance from the bottle 9, the application system 19 forms a pump in the example shown. The upper part of the application system 19 can be pressed down against a spring force by pressing on the annular area 21, as indicated by the arrows, and thereby the system pumps a dose outward through the nozzle 22 as a spray jet.

The FIG. 6 shows the protective cap 1 as seen from above toward its end face. For this, the initial deblocking motion is indicated with the small arrow on the end face of the protective cap 1, namely pressuring the protective cap 1 in the direction of the bottle 9 or the container. Subsequently, the protective cap must be screwed in counterclockwise direction while continuing the initial pressure against the bottle. The thickened regions 7 then fully reach in the interior of the groove-like threads 15 and can in these be further unscrewed along the threads and from these. For the subsequent unscrewing, the protective cap 1 must be rotated downwardly and under pressure in counterclockwise direction only at the beginning and only until the stop faces 8 are rotated past the undercuts 18, in the direction indicated by the circular arrow on the top of the protective cap 1. Then no more pressure is needed on the protective cap 1, and it can be unscrewed quite normally along its threads.

The FIG. 7 shows the bottle represented as an outline as a container with application system 19 mounted thereupon and the protective cap 1 placed thereupon, wherein the bottle 9 and protective cap 1 are represented in a longitudinal section along the line A-A of FIG. 6 and along the rotational axis. As one recognizes, a suction tubelet 23, which belongs to the application system 19, extends down into the bottle body 9. The decisive feature for the protective function of the protective cap 1, however, are the threads 15 in the spout 12 and the threads 6 on the inner side of the protective cap 1, as well as the realization or the form of the neck 11 of the spout 12 as it becomes clear in the following. The protective cap 1 can be screwed onto the spout 12 along the cap's threads 6, which form two inwardly protruding beads, by a rotation of the protective cap 1 clockwise as seen from above. In the process, the elevated threads 6 are pushed into the groove-shaped threads 15, which are formed at the outer side of the spout 12. Toward the end of the unscrewing of the protective cap 1, its lower edge 24 abuts against the neck 11 of the spout 12, and the walling of the lower protective cap mouth is thereby slightly deformed, until the tamper-evident band 2 rests on the shoulder 25 on the bottle body 9. This can be best recognized in the enlarged representation of the lower edge region of the protective cap 1 with the help of section C in FIG. 7. But first the stop face 8 catches the thickened end portion 7 of the thread 6 behind the undercut 18 (FIG. 4) and the thickened end portion 7 came to lie in the upper region of the broadened region 17 of the groove-shaped thread 15 in the spout 12, under slight elastic deformation of the wall of the protective cap mouth. With the elastic spring force of the protective cap mouth, the protective cap 1 and the thickened end portions 7 are permanently squeezed upward against the threads 6 (FIG. 2) so that the thus resulting latching effectively prevents the rotation of the protective cap 1 and therefore its unscrewing.

In FIG. 8, the bottle is represented as a section rotated in counterclockwise direction by around 65° toward the viewer in comparison to the representation in FIG. 7, and here one recognizes, with the help of the enlarged detail D and the shown section along the line B-B in FIG. 6 through the threads 6, 15, how the thickened region 7 of the thread 6 is widened in the groove-like thread 15 at its end, at which the groove is broadened in the region 17 (FIG. 4), is upwardly displaced and thus abuts against the undercut 18 in the region 17 in the groove.

The protective cap 1 rest on top in mounted position on the bottle shoulder 25 supported by the tamper-evident band 2. In this manner it is prevented that the protective cap 1 can be pressed against the bottle 9 at all as long as the tamper-evident band 2 is intact. The blocking mechanism of the threads 6, 15, however, can also not be overcome and unscrewing the protective cap 1 is impossible. Removing the protective cap 1 is blocked until the tamper-evident band 2 is removed. In order to tear away the tamper-evident band 2, this is interrupted in one place. A pull-off tab 3 is attached at this breaking point 10, at which the user can grasp the tamper-evident band 2 and pull it from the protective cap 1 and thus remove it completely from the protective cap 1. Only upon a removed tamper-evident band 2 is pressing the protective cap 1 against the bottle or the container possible, and the protective cap 1 can hereinafter be taken from the bottle 9 or the container.

In order to unscrew the protective cap 1, the tamper-evident band 2 must thus be torn off first. Then the protective cap 1 can be pressed first in axial direction against the bottle 9, which is effected with a slight elastic deformation of the walling of the protective cap mouth. In this connection, this walling of the neck 11 forms a slide-off surface and is flared conically downward in interrupted distances, and when pressing down the protective cap 1 therefore effectuates an elastic deformation of the lower region of the protective cap 1 corresponding to the pentagonal neck 11, as seen here from above, flaring conically downward. A certain force is thus required in order to press the protective cap 1 downward against the bottle and to somewhat deform it at the lower edge. The geometry of the slide-off surface can be laid out in such a way that it is made distinctly more difficult for children to apply the required force. Depending on how strong the wall thickness is configured, the elastic deformation can make a larger or smaller amount of force necessary. To remove the protective cap, it must first be pressed against the container or bottle. Only then can it be unscrewed under at first persistent pressure in counterclockwise direction, and after an initial rotation by a few angular degrees, the protective cap 1 can then be unscrewed without further pressure against the bottle. For the purpose of this unscrewing, the indentations 4 on the outside contour of the protective cap 1 are shaped so that the other wall parts form handle grooves to guarantee a better surface feel. The stripping of the tamper-evident band 2 is irreversible, by which can be ensured that the product is unutilized upon an intact tamper-evident band 2.

The invention claimed is:

1. A child-resistant protective screw-cap with cap cover, side wallings and opening, operable to be screwed onto an associated threaded neck of a container or bottle for liquid or pasty media, said screw-cap forming a closure for an application system mounted onto said threaded neck and forming a mouth at a top for pumping of said liquid or pasty media out of the container or bottle, wherein the protective screw-cap is unscrewable only upon simultaneous depressing and thus releasing of a lock on the thread of the neck of the container or bottle, the protective screw-cap comprising:

two mutually opposing separate bead-like threads on an inner lower side of the side wallings, each of said threads with a widened end region, so that a stop face is formed on each of the widened end regions, wherein upon screwing the protective screw-cap on, the stop faces on the two mutually opposing bead-like threads are operable to catch behind two mutually opposing undercuts on groove-like threads on the neck of the container or bottle so the protective screw-cap is locked symmetrically on to opposite positions of circumference of the neck of the container or bottle, and the stop faces are removable out of the undercuts only by pressing the protective screw-cap toward the container or the bottle under elastic deformation of the side wallings of the protective screw-cap opening at the neck, which for this purpose forms a downwardly flaring slide-off surface, and hereinafter in an unlocked position of the stop faces the protective screw-cap is unscrewable upon simultaneous rotation, and on an inner side of the cap cover a sleeve is formed which extends away from the cap cover concentrically to the protective screw-cap, said sleeve is fittable over the mouth of the application system mounted onto said threaded neck of the container or bottle so that an evaporation protection is formed and, upon unscrewing, the protective screw-cap is rotatable with said sleeve around said mouth whereby a definite rotational axis is provided.

2. The child-resistant protective screw-cap according to claim 1, wherein at a lower edge of the protective screw-cap a tamper-evident band is molded over one or more thin places or over one or more predetermined breaking points, and at one place in the circumferential direction said tamper-evident band is interrupted and has a pull-off tab.

3. The child-resistant protective screw-cap according to claim 1, wherein the neck of the bottle spout flares downwardly and forms a pentagonal cross shape when seen from top of the protective screw-cap so that faces of the pentagonal shape lying between corners of the pentagonal shape form elastically yielding slide-off surfaces for the lower edge section of the protective screw-cap.

* * * * *